US006431752B1

(12) United States Patent
Diplock

(10) Patent No.: US 6,431,752 B1
(45) Date of Patent: Aug. 13, 2002

(54) PLASTIC COIN TRANSPORT BAG

(76) Inventor: Jonathan Diplock, 209 Elizabeth Ave., Westfield, NJ (US) 07090

( * ) Notice: Subject to any disclaimer, the term of this patent is extended or adjusted under 35 U.S.C. 154(b) by 0 days.

(21) Appl. No.: 09/785,017

(22) Filed: Feb. 16, 2001

Related U.S. Application Data

(63) Continuation-in-part of application No. 09/447,475, filed on Nov. 23, 1999, now Pat. No. 6,190,043.

(51) Int. Cl.[7] ..... B65D 33/34

(52) U.S. Cl. ..... 383/5; 383/10; 383/66; 383/78

(58) Field of Search ..... 383/10, 5, 78, 383/66

(56) References Cited

U.S. PATENT DOCUMENTS

| | | | | |
|---|---|---|---|---|
| 1,211,367 | A | 1/1917 | Gargano | |
| 3,942,713 | A | 3/1976 | Olson et al. | |
| 5,108,194 | A | 4/1992 | Raden | |
| 5,352,041 | A | 10/1994 | Fullerton et al. | |
| 5,908,243 | A | 6/1999 | Hanning | |
| 6,190,043 | B1 * | 2/2001 | Diplock | 383/5 |

FOREIGN PATENT DOCUMENTS

| | | | |
|---|---|---|---|
| EP | 0134129 | 3/1985 | |
| EP | 0259068 | 3/1988 | |
| EP | 0341699 | 11/1989 | |
| EP | 0373748 | 6/1990 | |
| EP | 0 396 428 | 11/1990 | |
| FR | 2 681 581 | 3/1993 | |
| GB | 2238291 | * 5/1991 | 383/10 |
| GB | 2 265 883 | 10/1993 | |
| WO | WO 91/15406 | 10/1991 | |
| WO | wo 93/00269 | 1/1993 | |

* cited by examiner

*Primary Examiner*—Jes F. Pascua
(74) *Attorney, Agent, or Firm*—Edward Dreyfus

(57) ABSTRACT

A plastic coin bag for transporting a load of loose coins includes a slot opening in the front panel, a closure member for sealing the closure member to close and seal the slot opening, a back panel forming a coin storage chamber with the front panel, and a patch panel located between the upper portions of the front and back panels to increase the manual carrying capacity and the strength of the bag handle or hand-grip opening region. A transverse secure line below the hand-grip opening seals the three panels together and forms the top of the storage chamber. In one embodiment, the patch panel can extend into the storage chamber to below the slot opening in the front panel to adhere to the closure adhesive if the slot is improperly spread open during press closing. This feature prevents coins from sticking to the adhesive or the false tripping if the closure comprises tamper evident tape and the back panel adheres to the closure adhesive. Other features disclosed can include a heat seal joining the three panels above the grip opening to further strengthen the handle area, at least two tear-off receipts to accommodate the usual same data entered on each receipt to match the front panel data, and side seals to complete the closed storage chamber.

14 Claims, 9 Drawing Sheets

PLASTIC COIN TRANSPORT BAG

RELATED APPLICATION

This is a continuation-in-part of co-pending U.S. patent application Ser. No. 09/447,475, filed Nov. 23, 1999, which matured to U.S. Pat. No. 6,190,043.

BACKGROUND

The present invention relates to plastic security bags and more particularly to such bags used for secure transport and delivery of coins and other similar items that are transported in bulk from one location to another such as a retail facility to a bank.

One prior known description of these types of bags is found in U.K. published Patent Application GB2,238,291A, incorporated herein by reference, which includes a thermoplastic bag having front and back panels folded from a single sheet. The edges are marginally heat sealed with, if desired, security printing between the marginal side edges and transversely heat sealed adjacent one of the folded over edges and having a cut out part to form a carrying handle portion between the top fold of the sheet and the heat seal, a portion of the top folded over part outside the transverse heat seal, constitutes a flap to engage the other of the folded over parts, to close the bag when the flap is folded into contact with the other of the folded over parts to seal the bag.

The standard practice in the United States is to use canvas bags for coin transport. These bags are intended for return and re-use and are designed to carry 50 pounds of loose coins, usually of a single denomination (pennies, nickels, dimes, etc). Security is provided by straps around the bag neck secured by lead seals.

There is a need in the U.S. to use secure thermoplastic, disposable bags for transport of 50-pound coin loads. Since the bags must be handled manually during their journey, the bag should have design features enabling or facilitating hand pick up and carry of the bags. Security breaches and inadvertent opening must be prevented even when the bag is accidentally dropped or the loose contents shift during transport.

Although British Patent Application mentioned above purports a convenient design for handling such bags, various technical problems are inherently associated with the same, such as the thermostatic material tends to tear under heavy loads (lifting forces) at upper, outer ends of the handle opening. If the material ply is increased to off-set this problem, then the heat seals lose integrity. If the panel side slot opening is not fully closed upon sealing the bag, then the hot-melt adhesive on the flap extends through to the inside surface of the back panel. If a tamper evident flap seal is used and the coins shift toward the top of the bag during transport then the tamper feature can be falsely tripped by the shifting content. See U.S. patent application Ser. No. 09/447,475 filed Nov. 23, 1999 by the same applicant hereof, incorporated herein by reference. Also, some coins will stick to adhesive after the bag is emptied.

SUMMARY OF PRESENT INVENTION

The present invention solves the foregoing problems and provides further benefits and improvements in secure coin transport bags. One exemplary embodiment includes a thermoplastic coin bag with a false plastic panel extending above and below the handle opening and downward into the bag storage compartment to below the front panel transverse slot opening. This false or patch panel prevents shifting contents from falsely tripping the tamper evident feature by its adherence to the external closure adhesive if the slot opening is inadvertently or improperly spread during closure. Also, coins will not stick to the adhesive. In addition, the patch panel extends upward so that the upper part of the bag comprises 3 panel layers instead of two panel layers to increase the lifting strength and integrity of the handle and top bag areas. Multiple receipt options are easily extended from the top of the bag for the user, courier and/or processor.

DRAWING DESCRIPTION

Other and further objects and benefits of a plastic coin bag according to the principles of the present invention will become apparent with the following detailed description when taken in view of the appended drawings, in which.

Figure 4:
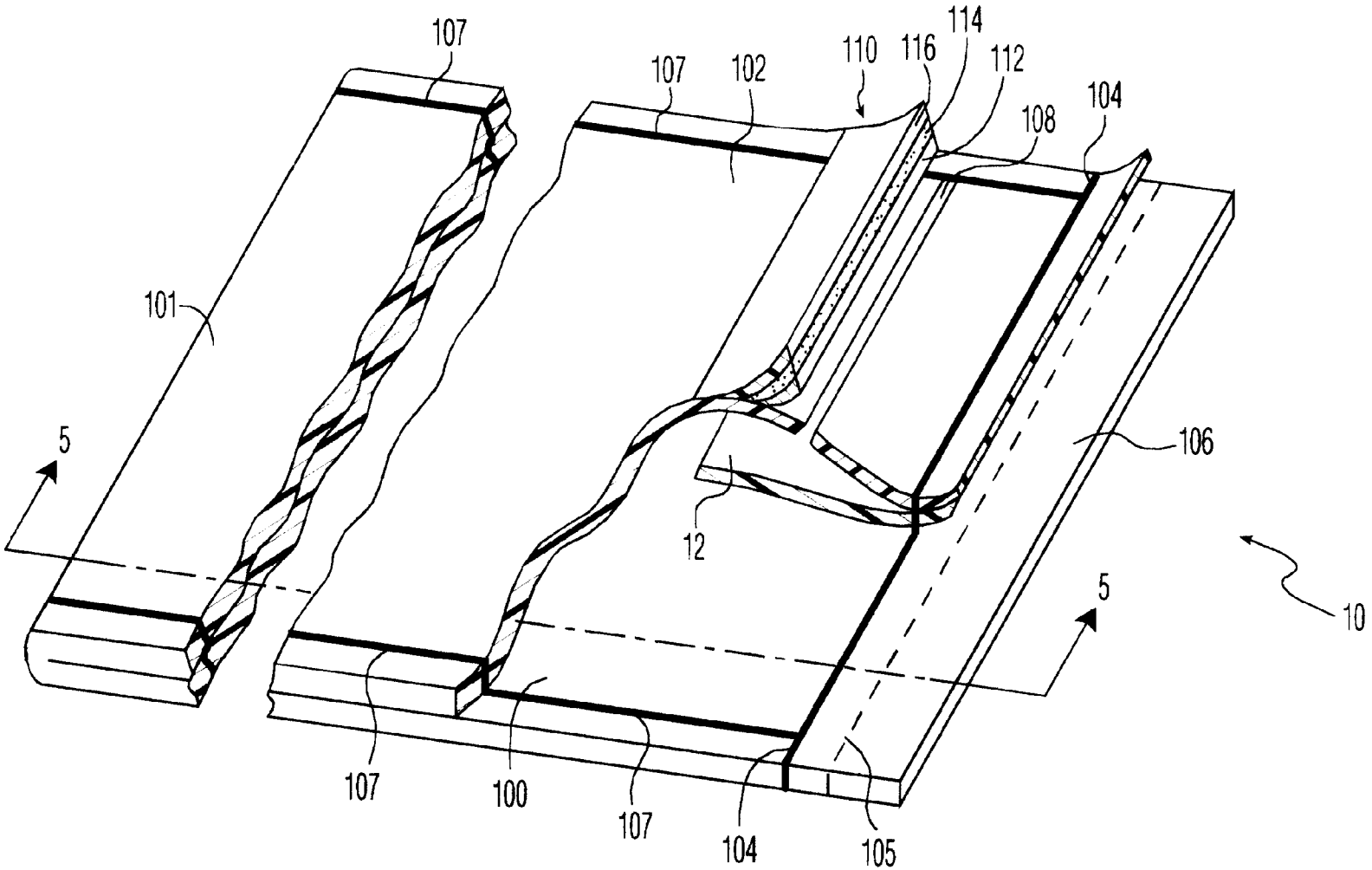

FIG. 4 is a partial perspective view of one exemplary embodiment according to the principles of the present invention with parts broken away. Note common reference numerals refer to elements common with FIGS. 9 and 10. The envelope of FIG. 4 is in its manufactured but unused condition.

Figure 5:
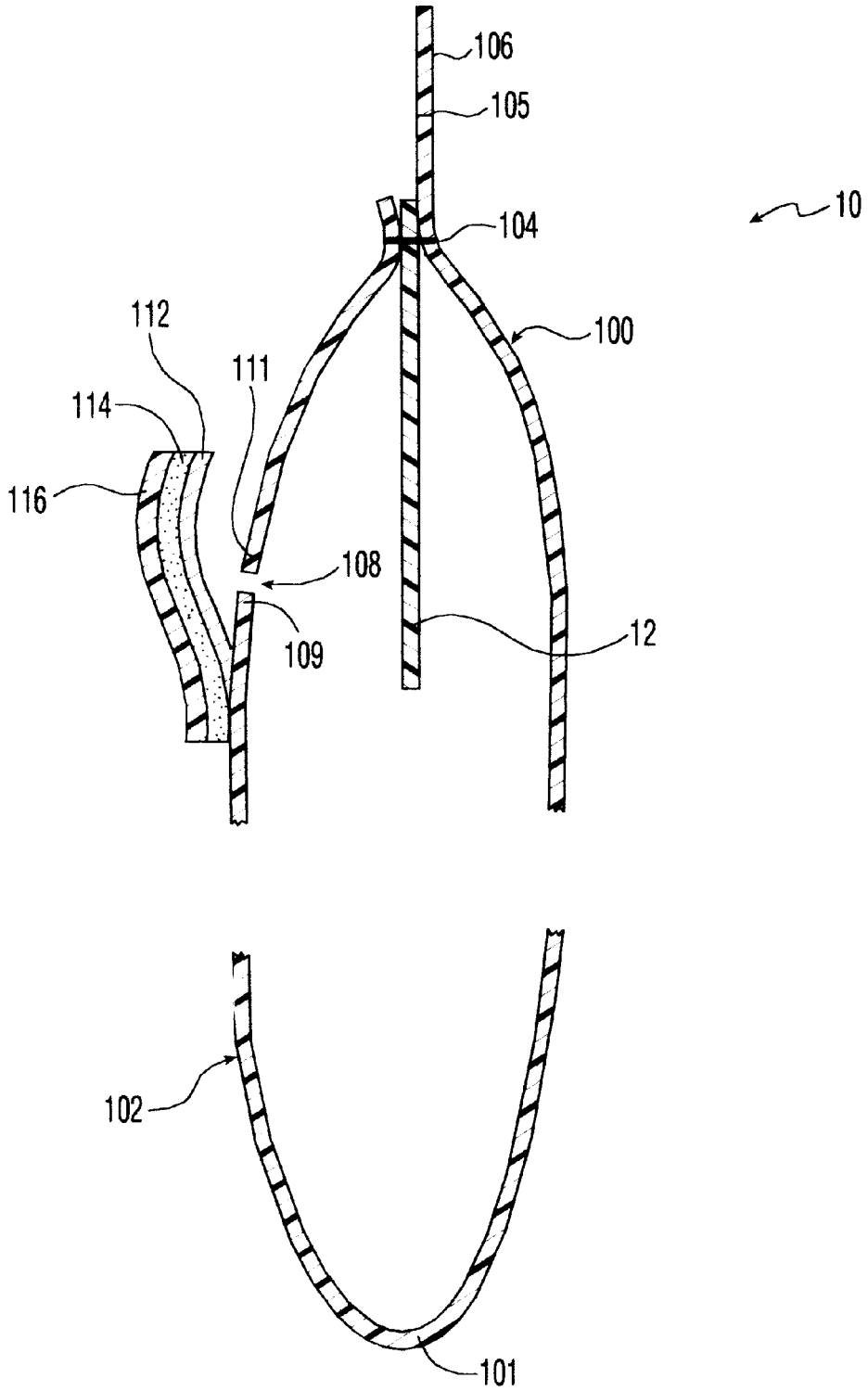

FIG. 5 is a side sectional view taken along line 5—5 of FIG. 4.

Figure 6:
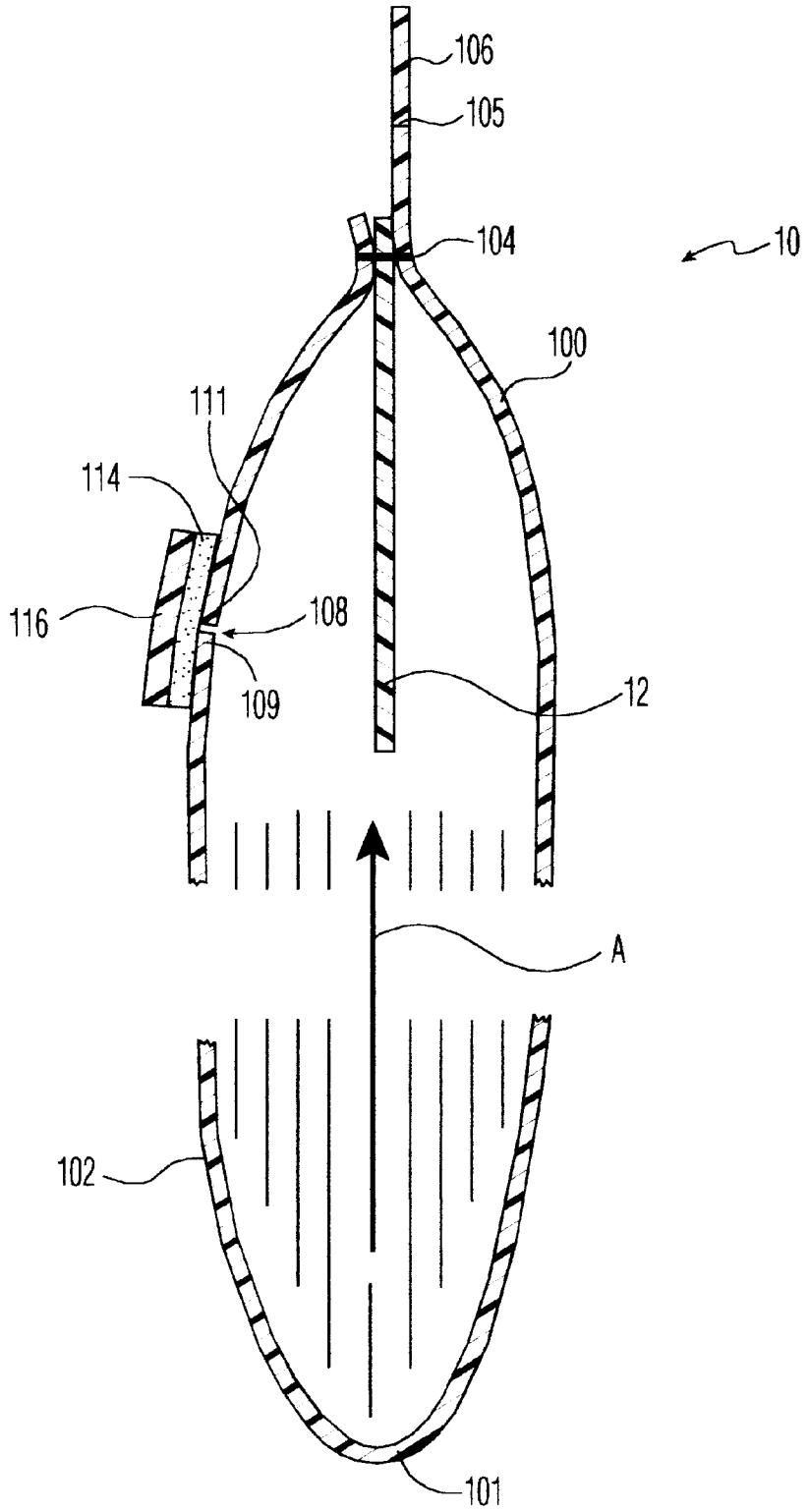

FIG. 6 is similar to FIG. 5 after the envelope has been properly closed and sealed.

Figure 7:
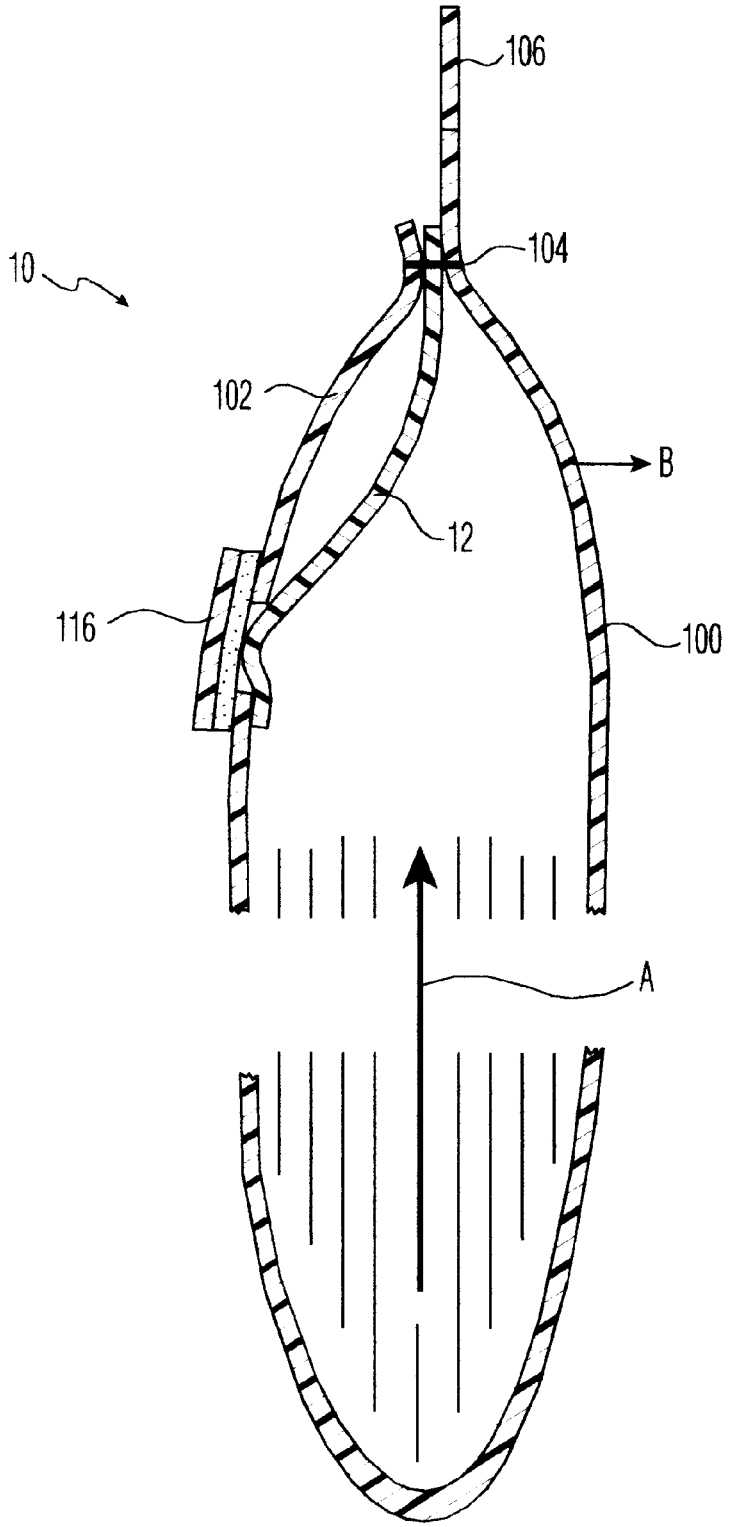

FIG. 7 is similar to FIG. 5 after the envelope has been improperly closed and sealed.

Figure 8:
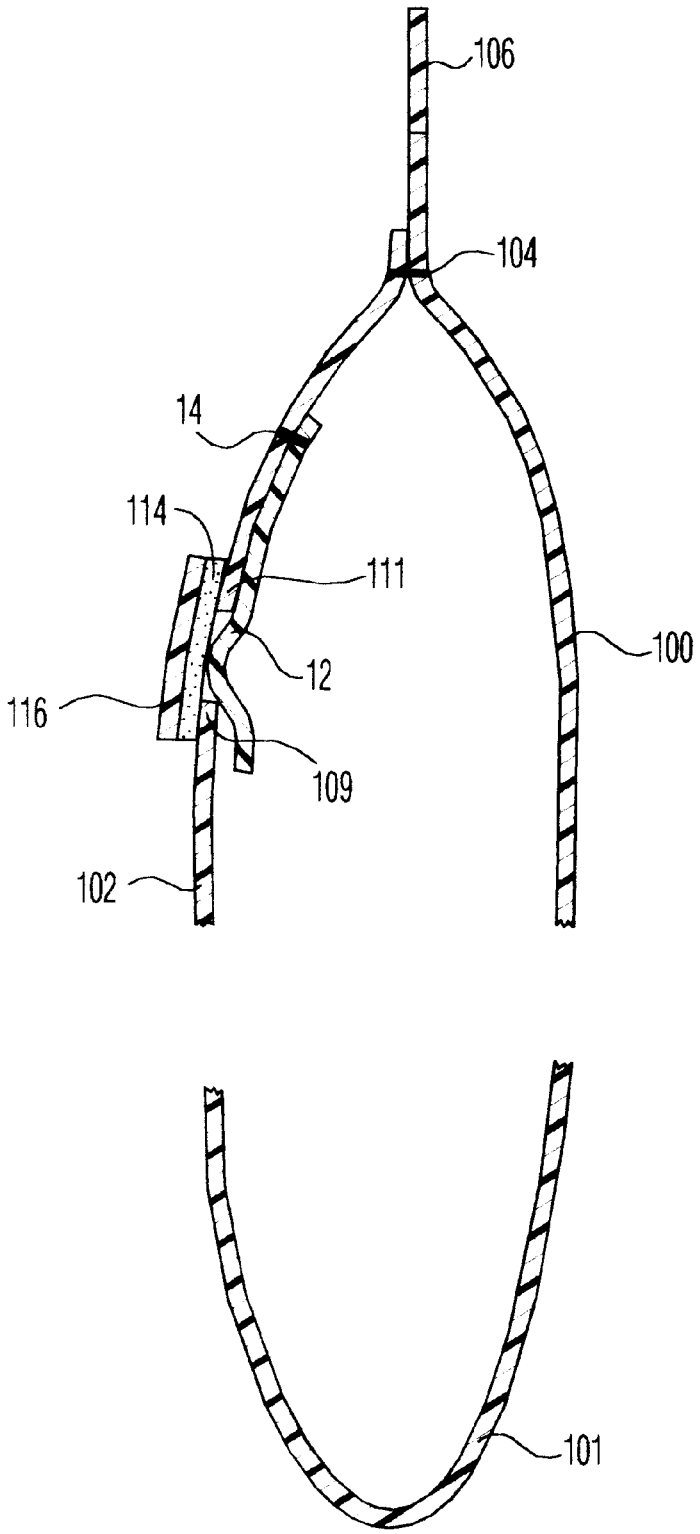

FIG. 8 is similar to FIG. 7 showing an alternate embodiment of the present invention.

Figure 9:
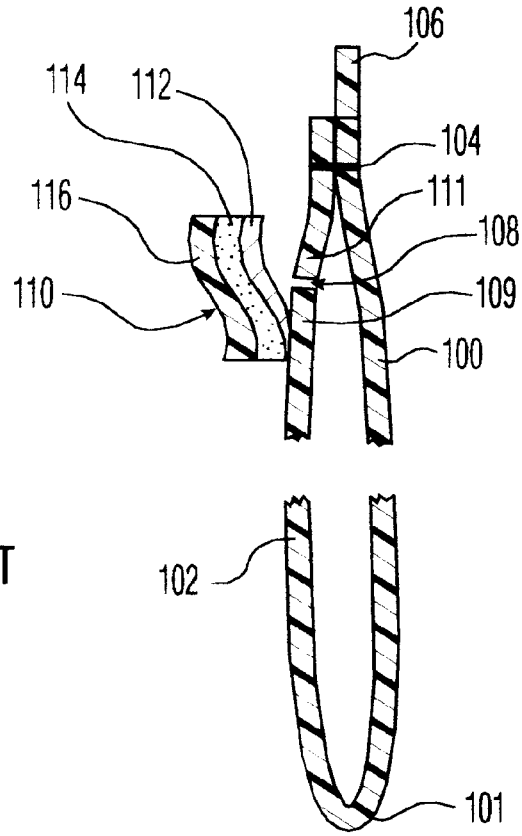
FIG. 9 PRIOR ART

FIG. 9 is similar to FIG. 5 showing a conventional prior art embodiment.

Figure 10:
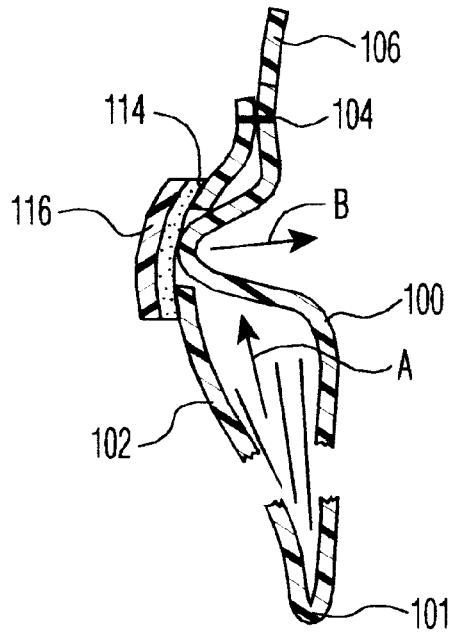
FIG. 10 PRIOR ART

FIG. 10 is similar to FIG. 9 after the prior art envelope has been improperly closed and sealed.

DETAILED DESCRIPTION OF THE EMBODIMENTS OF THE INVENTION

Figure 1:
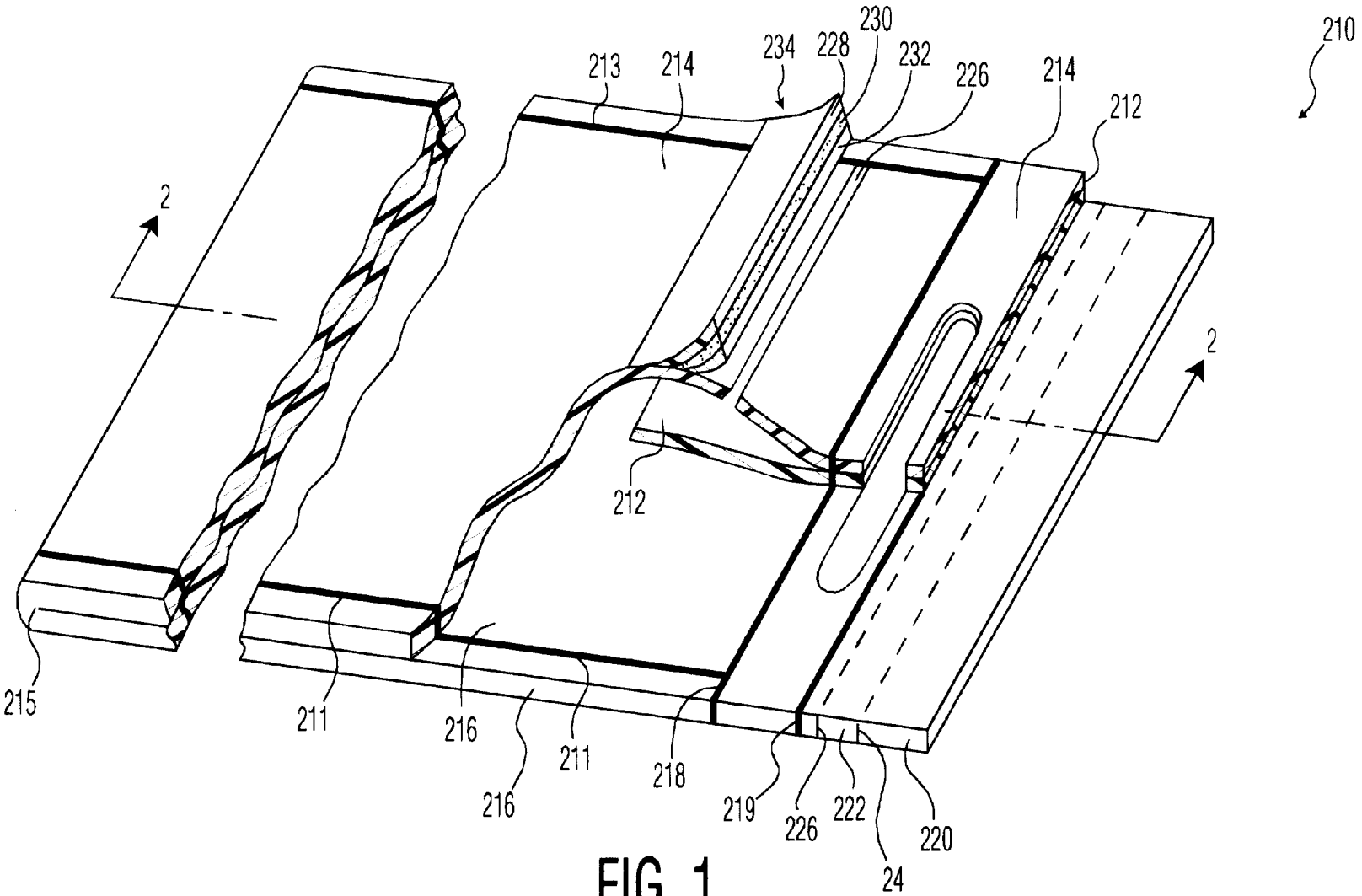
FIG. 1 is a perspective view of a coin bag according to the principles of the present invention with parts broken away.
Figure 2:
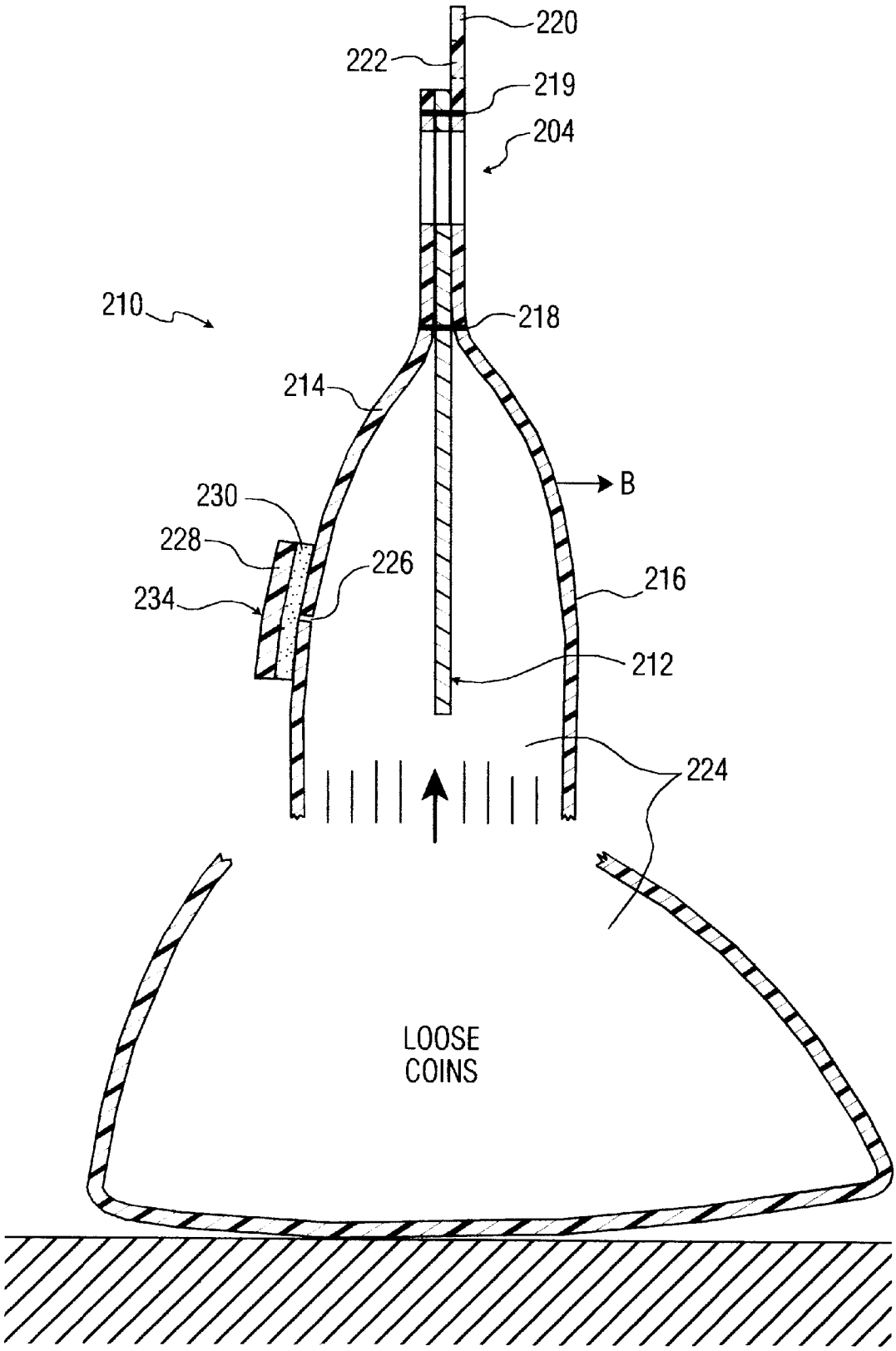
FIG. 2 is a side section view taken along line 2—2 of FIG. 1 showing the coin bag with a full load of loose coins in the bag chamber and the side fill slot properly closed and sealed.
Figure 3:
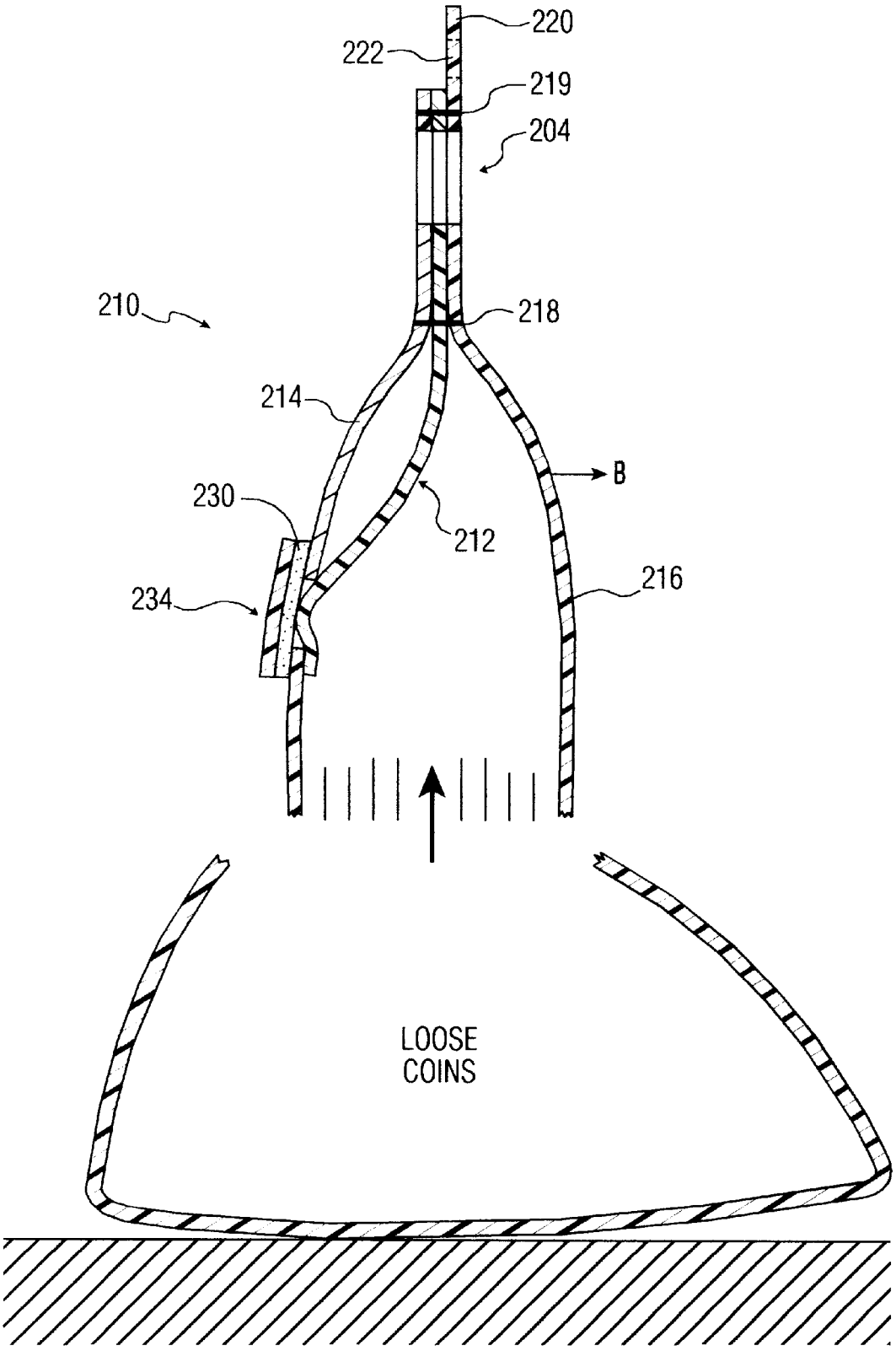
FIG. 3 is similar to FIG. 2 showing the side fill slot improperly spread and sealed.

With reference to FIGS. 1–3, bag 210 is one exemplary embodiment according to the principles of the present invention includes a front panel 214, back panel 216 that preferably extends upward beyond the front panel to form first and second tear-off receipts 220, 222 separable at first and second tear-off receipts 20, 22 separable at perforations 224, 226 and extending across at least a part of the bag width. Each receipt can be separated and retained at different stations of transport. Front and back panels are secured by vertical side heat seals 211, 213 a bottom fold 215 and preferably by two vertically space transverse heat seals 218, 219. Heat seal 218 closes the top of the storage chamber 224 (FIG. 2) formed by panels 214, 216. Panel 214 includes a transverse slot opening 226 through which coins or other contents can be inserted into chamber 24. Opening 26 can extend substantially between side seals 211, 213.

Bag 210 also includes a suitable closure such as closure 234 to close and seal opening 226 when all contents have been inserted into chamber 224. Closure 234 can include a plastic sealing member 228 initially having one edge secured to panel 214 below slot opening 226 by a portion of adhesive layer 230. The remainder of layer 230 is protected from premature adhesion by paper or plastic liner 232. When the user desires to close and seal, user removes liner 232 and presses member 228 against panel 214 to bridge slot 226.

Alternately, closure 243 can be initially secured above slot 226 instead of below slot 226 as shown in FIG. 1. Liner removal and pressing to bridge slot 226 would produce the same combination shown in FIG. 2.

Bag 210 further includes a false or patch panel 212 positional between the upper parts of panels 214, 216. The mid-portion of panel 212 is secured by heat seal 218. Panel 212 includes a lower portion that extends into chamber 224 to below slot 226 and an upper portion that extends from seal 218 to above handle grip-opening 224. In this example, upper portion of panel 212 extends within and is secured by heat seal 219. Panel 212 provides protection against a false security breach of the closure 234 and added carrying strength to the handle portion of bag 210 to reduce tearing or damaging the handle during transport.

The upper portion of bag 210 forms a handgrip or carry handle for lifting and carrying the loaded bag. To this end, opening 204 is formed through panels 214, 216 and patch panel 212 further described below. Opening 204, in one example, is elongated in the transverse direction, has semi-circular or suitably rounded transverse ends and is dimensioned to accommodate four cupped or curled fingers of a typical male hand. It will be understood that panels 214,216 must be sufficiently thick to resist the dynamic forces of its content without stretching or tearing. In one example, panels 214, 216 comprise primarily polyethylene with various conventional additives with a general thickness of 6 mils or more. However, panel 212 can be of thinner and of a different material composition because it functions at its upper portion to simply augment the carrying strength of the outer two panels at and above seal 218. If panel 212 extends to under heat seal 219, as shown, augmentation of carrying forces also includes seal 219 as well.

In operation, coin bag 210 is initially in condition shown in FIG. 1. Slot 226 is spread by the user and coins are inserted through slot 226 into chamber 224. The bottom of bag spreads out on a supporting surface. Standard loads in the United States approximate 50 pounds. When fully loaded, user peels off liner 232 to expose adhesive 230. User attempts to align the lips of slot 226 adjacent to each other before pressing closure member 228 and adhesive layer 230 to bridge slot 226 and adhere to panel 214. If slot 226 is properly closed, FIG. 2, false panel 212 simply extends freely toward the chamber bottom. The forces of coins shifting toward the chamber top (see arrow) will be absorbed by heat seal 218 and the upper panel portions. If closure 234 includes tamper-indicating means, such means will remain in tact and not be falsely tripped by coin shift forces because there shall have been no lateral force on adhesive layer 230.

In the event bag 210 is improperly closed (FIG. 3) with slot 226 lips spread apart, liner 232 removed, tamper tape member 228 pressed closed and sealed, then panel 212 will adhere to layer 230 generally as shown in FIG. 3. In this condition, contents shifting to the top of bag 210 slide passed panel 212 and apply stress forces on heat seal 218 instead of closure layer 230. Thus, false tamper indications and coins sticking to layer 230 shall be avoided because panel 212 remains adhered to closure 234. Outward forces, such as arrow B, applied to panel 216 in FIG. 3 are also taken up by seal 218 and the side seals 211, 213 rather than layer 230 and tape member 228 of closure 234.

It will be apparent that none of the figures are necessarily drawn to scale. Other and further modification, enhancements, and changes can be made to the herein disclosed embodiments without departing from the spirit and scope of the present invention. The selection of materials can be standard and are well known in the art.

The above mentioned parent patent application includes the following text and FIGS. 4–10, hereof.

The background of co-pending application Ser. No. 09/447,475 will now be described in the following text.

The invention of said co-pending application relates to plastic secure packages and more particularly to such packages for having and conveying valuable documents and items and that have tamper evident closures. As used herein, package, envelope, bag and container shall mean equivalent structures.

There are many types of plastic security envelopes with tamper evident features. One common type is shown in FIG. 9 and includes a plastic envelope having a rear panel 100 a front panel 102. These panels could be joined at the bottom by heat seals or adhesives or formed from a single sheet folded back on itself at the bottom 101 as shown in FIG. 9. Side seals, not shown, are formed along both side-edge regions by applying adhesives or hot sealing the internal panel edges together. The upper ends of panels 100 and 102 are joined at 104 by a heat seal extending the width of the bag or by suitable hot melt adhesive as desired. An optional tear off receipt 106, suitably numbered, can be attached to one of the panels via weakened perforations 105.

A generally horizontal slit 108 is formed in front panel 102 to enable the user to introduce documents or items into the chamber of the envelope. A tamper evident sealing member 110 is provided to close and seal slit 108 and provide evidence of any tampering such as using cold dry ice or freon gas or hair dryer heat or clear adhesive tape reinforcement to remove a portion of member 110 to gain access to the housed documents or to give tamper evidency if stress forces are applied to member 110. Common and commercially available member 110 includes a tamper evident tape 116 with hot melt adhesive layer 114 one portion of which is secured to the front panel outer surface contiguous to slit 108. Conventionally, layer 114 can include imbedded graphics such as the word "void" that would appear in response to various stresses or temperatures used for tampering. The remainder of layer 114 is initially protected by a removable paper or plastic liner 112 that prevents premature or unwanted adhesive contact with the panel or any other thing. After the documents and/or items are inserted into the envelope, liner 112 is removed and member tamper evident tape 116 pressed to close and seal across slit 108. Tape 116 functions to give a special visual indication, such as multiple appearances of the word "VOID" or other graphics, if the tape had been subjected to one of several types of tampering or, alternatively, tape 116 may be designed to tear or flake or crack or shrivel to give a visual tamper indication. Various materials are commonly known to provide the above functions.

Although this type of envelope performs with some degree of reliability a technical problem exists because of a common human error in usage. Users of this type of secure package tend to be less than careful in assuring that slit 108 is substantially closed when pressing layer 116 to its closed and sealed position. Sometimes the thickness of the stack of documents or the thickness of items within the envelope cause lips 109, 111 defining slit 108 to separate. Sometimes the user pulls panel portion 109 outward when removing liner 112, then quickly applies layer 114 to the portion 111 of panel 102. On occasion, the user pulls up on the top of the bag with one hand, while releasing the liner and pressing 116 with the other hand. In any case, when improperly closed and sealed the central portion of layer 114 is exposed through the widened slot 108 and when pressure is subsequently applied to tamper tape layer 116 a portion of the inner surface of panel 100 adheres to layer 114, generally as shown in FIG. 10. Thereafter, transport or handling of the envelope on occasion causes the housed documents or items to shift in the direction of arrow A which tends to separate panel 100 from layer 114 in the general direction of arrow B, which in turn stresses layer 114 causing the tape to display, erroneously, a tampering attempt indication. This false tampering indication is costly and time consuming for the users and for the customers whose documents or items are being transported because the receiving entity, such as a bank, will not accept the bag showing tamper evidence and will return it to the sender, such as a department store, for re-packaging and shipment.

It is an object of the present invention to provide a plastic security envelope of the type described that avoids the aforementioned problems, prevents or greatly reduces the chances for an erroneous tamper indication for the reasons described, enhances the reliability of envelopes of the type described without adding significantly to the cost or processes of manufacturing such envelopes.

According to the principles of the present invention, one exemplary embodiment includes an envelope of the type described that includes a false or intermediate panel piece secured preferably above the slot and inside the envelope between the front and back panels which piece extends preferably downward across the zone of the slot. If the bag is properly closed and sealed by the tamper tape with the lips of the slot essentially touching or contiguous, the false panel simply remains unsecured and provides neither positive nor negative function or effect to the envelope. However, if the tamper tape is closed and sealed across the slot and the slot lips are improperly spaced apart, then when pressure is applied to the tamper tape, the false internal panel adheres to the internal surface of the adhesive layer. Thereafter, unlike the prior art, any outward forces imparted to the rear panel by shifting contents or otherwise are taken up by the top and side seals and the false intermediate panel remains unstressed against the tamper tape adhesive and false tamper indications are avoided.

These and others objects, aspects, and benefits afforded by the principles of the present invention will be understood from the following detailed description of exemplary embodiments of the present invention when taken in view of FIGS. 4–10.

With reference to FIGS. 4–8, unlike the prior art, envelope 10 includes false or intermediate internal panel 12 with its upper edge portion secured between panels 100, 102 by heat seal 104. The side edges of panel 12 are, in this example, secured between the panels by the side heat seals 107 or, if desired, the side edges of panel 12 can be contiguous but not secured by the side seals. In any event, Panel 12 should run at least the lateral extent of slot 108. Panel 12 extends toward the bottom of envelope 10 at least to a predetermined distance below slot 108 that assures the function described below. Member 110 can be located generally as shown but can alternately be initially secured above slot 108 instead of below it.

During proper operation envelope 10 is laid on a flat surface, contents are placed into the envelope through slot 108. Liner 112 is removed and with slot 108 essentially closed by lips 109, 111, tamper tape 116 is pressed to the closed, sealed position shown in FIG. 6. Since adhesive layer 114 is essentially unexposed through slot 108, panel 12 simply lies loosely between panels 100, 102. Panel 12 had not nor will not interfere with the normal placing of contents within the bag nor the movement of contents within the bag after closure.

In the event envelope 10 is improperly closed with lips 109, 111 spread apart, liner 112 removed, tamper tape member 110 pressed closed and sealed, then panel 12 will adhere to layer 114 generally as shown in FIG. 7. In this condition, contents shifting to the top of envelope 10 slide past panel 12 and apply stress forces on heat seal 104 instead of layer 114. Thus, false tamper indications are avoided. Outward forces, such as arrow B, applied to panel 100 in FIG. 7 are also taken up by seal 104 and the side seals 107 rather than layer 114 and tape 116.

With reference to FIG. 8, an alternate position of panel 12 is to secure, for example, its top edge to the inside of the rear panel 102 somewhat above slot 108 by an additional adhesive or heat seal strip 14, as desired. Panel 12 in this alternative embodiment also will not affect content loading or movement after closure.

It will be apparent that none of the figures are necessarily drawn to scale. Other and further modification, enhancements, and changes can be made to the herein disclosed embodiments without departing from the spirit and scope of the present invention. The selection of materials can be standard and are well known in the art.

What is claimed is:

1. A plastic coin bag for transporting a plurality of loose coins comprising a front panel with lips defining a slot opening in the front panel for insertion of coins, a closure member having an adhesive layer for sealing the closure member to said lips to close and seal said slot opening to form a closed chamber, a back panel for forming a coin storage chamber with said front panel, a patch panel located between the upper portions of said front and back panels, and the said front and back panels and said patch panel defining an opening located between said slot and the top of the bag and extending through said panels for accommodating at least part of a human hand for lifting or carrying the coin bag.

2. A plastic coin bag for transporting a plurality of loose coins comprising a front panel with lips defining a slot opening in the front panel, a closure member having an adhesive layer for sealing the closure member to said lips to close and seal said slot opening, a back panel for forming a coin storage chamber with said front panel, a patch panel located between the upper portions of said front and back panels, said front and back panels and said patch panel defining an opening extending through said panels for accommodating at least part of a human hand for lifting or carrying the coin bag, and wherein a transverse heat seal extends laterally of the front, back, and patch panels for securing parts of said panels together.

3. A coin bag as set forth in claim 2, wherein said heat seal and secured panel parts form the top of said storage chamber.

4. A coin bag as set forth in claim 2, wherein heat seal is spaced below said opening.

5. A plastic coin bag for transporting a plurality of loose coins comprising a front panel with lips defining a slot opening in the front panel for insertion of coins, a closure member having an adhesive layer for sealing the closure member to said lips to close and seal said slot opening to form a closed chamber, a back panel for forming a coin storage chamber with said front panel, a patch panel located between the upper portions of said front and back panels, and the said front and back panels and said patch panel defining an opening located between said slot top of the bag and extending through said panels for accommodating at least part of a human hand for lifting or carrying the coin bag, and wherein said closure member is initially partially secured to said front panel adjacent said slot and comprises an adhesive layer for securing said closure member to said lips when the bag is closed.

6. A coin bag as set forth in claim 5, wherein a release liner removably covers said adhesive layer to prevent premature adhesion of said adhesive layer.

7. A coin bag as set forth in claim 2, wherein said front and back panels are secured together along a transverse line above said opening.

8. A coin bag as set forth in claim 7, wherein said patch panel extends between and is secured to said front and back panels along said transverse line above said opening.

9. A coin bag as set forth in claim 8, wherein said patch and front and back panels are secured along said by a heat seal.

10. A coin bag as set forth in claim 1, wherein said patch panel has a lower portion that extends into the storage chamber between said front and back panels.

11. A coin bag as set forth in claim 10, wherein said patch panel lower portion extends to below said slot opening.

12. A plastic coin bag for transporting a plurality of loose coins comprising a front panel with lips defining a slot opening in the front panel for insertion of coins, a closure member having an adhesive layer for sealing the closure member to said lips to close and seal said slot opening to form a closed chamber, a back panel for forming a coin storage chamber with said front panel, a patch panel located between the upper portions of said front and back panels, and the said front and back panels and said patch panel defining an opening located between said slot top of the bag and extending through said panels for accommodating at least part of a human hand for lifting or carrying the coin bag, and said patch panel has a lower portion that extends into the storage chamber between said front and back panels, said patch panel lower portion extends to below said slot opening, and wherein said patch panel lower portion adheres to said adhesive layer when said closure member is pressed across said slot opening and said slot opening lips are spread apart during such pressing.

13. A coin bag as set forth in claim 1, wherein said front and back panels are further secured together near their edges to partially form the closed storage chamber.

14. A plastic coin bag for transporting a plurality of loose coins comprising a front panel with lips defining a slot opening in the front panel for insertion of coins, a closure member having an adhesive layer for sealing the closure member to said lips to close and seal said slot opening to form a closed chamber, a back panel for forming a coin storage chamber with said front panel, a patch panel located between the upper portions of said front and back panels, and the said front and back panels and said patch panel defining an opening located between said slot top of the bag and extending through said panels for accommodating at least part of a human hand for lifting or carrying the coin bag, and wherein one of said front or rear panels extends above the other of said panels to comprise at least first and second tear-off receipts, the first tear off receipt being separable from the second by a transverse line of weakened material, and the second tear off receipt being separable from said one panel by a transverse line of weaken material.

* * * * *